US006401509B1

(12) United States Patent
Amborn

(10) Patent No.: US 6,401,509 B1
(45) Date of Patent: Jun. 11, 2002

(54) METHOD FOR PRODUCING A HOLLOW BODY MADE OF METAL

(76) Inventor: Peter Amborn, In den Gärten 2, Neunkirchen (DE), D-53819

( * ) Notice: Subject to any disclaimer, the term of this patent is extended or adjusted under 35 U.S.C. 154(b) by 0 days.

(21) Appl. No.: 09/649,464

(22) Filed: Aug. 25, 2000

(30) Foreign Application Priority Data

Sep. 17, 1999 (DE) ..... 199 44 679

(51) Int. Cl.[7] ..... B21D 9/18

(52) U.S. Cl. ..... 72/62; 72/342.6; 72/342.94; 29/421.1

(58) Field of Search ..... 72/57, 58, 61, 72/62, 342.6, 342.94; 29/421.1

(56) References Cited

U.S. PATENT DOCUMENTS 4,437,326 A 3/1984 Carlson
5,671,629 A * 9/1997 Valyi ..... 72/58
5,960,658 A * 10/1999 Hudson et al. ..... 72/61
5,992,197 A * 11/1999 Freeman et al. ..... 72/62
6,081,982 A * 7/2000 Schulz ..... 29/421.1

FOREIGN PATENT DOCUMENTS

DE 29 41 972 A1 4/1981
DE 44 03 897 C2 8/1995

* cited by examiner

*Primary Examiner*—David Jones
(74) *Attorney, Agent, or Firm*—James P. Hanrath

(57) ABSTRACT

The present invention relates to a method for manufacturing a hollow body made of metal whose cross sectional shape changes in longitudinal direction, a tubular slug being sealed at its end and being placed into a mold that corresponds to the desired shape and that is placed in a tool, said slug being then put under high pressure from the inside by means of a pressure means, whereas the two ends of the tube are pressed against each other in axial direction during the process of deformation, the slug being submitted during deformation to a higher temperature in the area of these great deformations than in the area of smaller deformations in order to produce areas with great deformations in its cross sectional shape.

4 Claims, 1 Drawing Sheet

METHOD FOR PRODUCING A HOLLOW BODY MADE OF METAL

BACKGROUND OF THE INVENTION

1. Field of the invention

The present invention relates to a method for manufacturing a hollow body made of metal whose cross sectional shape changes in longitudinal direction, a tubular slug being sealed at its end and being placed into a mold that corresponds to the desired shape and that is arranged in a tool, said slug being then put under high pressure from the inside by means of a pressure means, whereas the two ends of the tube are pressed against each other in axial direction during the process of deformation.

Another object of the invention is a tool to execute said method.

2. Description of the prior art

A method of the type mentioned above is known for example from DE 29 41 972. The tubular slug is thereby heated to more than 500° C. in the area that has to be deformed, the pressure means, a gas for example, being heated to at least 500° C. as well in order to make it easier for the material to flow into the shape of the tool's mold during the process of deformation. It is however well known that in the process of this so-called "hydrodeformation" only soft transitions between the diameters of the different cross sectional shapes can be selected. Indeed, only soft transitions toward greater circumferences guarantee that the hollow body made of metal does not form folds or laps when submitted to high axial pressures. This means that only small deformations with steep transitions or greater deformations with soft transitions are possible.

There is however also a need for tubular hollow bodies in the technique of hydrodeformation without such soft transitions, that have steep walls, i.e. steep transitions in cross section and very salient or protruding transitions in diameter, that is areas of great deformation.

SUMMARY OF THE INVENTION

In order to be capable of manufacturing by way of hydrodeformation such diameters with very protruding, steep transitions, that is with areas of great deformation, the present invention suggests to submit the slug in the tool to a higher temperature in the area of the great deformation than in the area of smaller deformation during the deformation procedure. This means that the temperature of the slug depends on the degree of deformation. As a result, the higher temperature increases the overall tensile ductility of the material. Of course the slug is being heated over its length, which is to be deformed, but the temperature is higher in areas with great deformations than in areas, where the deformation is smaller.

This also means that by pushing the two ends of the tube against each other, the material flows faster in this area and thus fills the mold faster than in other areas, in which the transitions chosen are less steep in cross section and less protruding.

At the places of smaller deformation, the slug can indeed be cooler, thus ensuring that the axial force exerted to press the two ends together is transmitted as far as the area of the steep, very protruding transitions. If the slug were heated uniformly, the metallic hollow body could form folds or laps in the area of the soft transitions because of the high temperature and the accordingly high flow behavior, without the corresponding axial force being carried on toward the area of the high transitions. This however is precisely needed in order to produce a metallic hollow body provided with essentially the same cross sectional dimension on the entire surface area.

During deformation of the slug, the mold advantageously has a higher temperature in areas with great deformations than in areas with smaller deformations. Thus, the slug may be prevented from cooling down too much at the corresponding places.

According to a particular characteristic of this method, the tool is designed in such a way that the mold has, in axial direction, two advantageously mirror-inverted mold parts, the areas of great deformations, i.e. of steep, widely protruding transitions being located in the central part of the tool mold, whereas the slugs are pushed together in axial direction and are somewhat advantageously pushed together in a controlled manner during deformation. When the areas of great deformations, i.e. of transitions of more than 45° and preferably less than 90° , are arranged precisely in the center of the mold, i.e. in the neighbourhood of one another between the two mold parts, this means that the axial forces applied to either side of the two tubular slugs practically cancel out in the center.

If, as already explained, the steep transitions are provided in the center of the mold, the two adjacent ends of the tube are pushing each other into the corresponding cavity in the mold or mold part so that the tubular hollow bodies are deformed accordingly while keeping essentially the same wall thickness.

Such a method also offers the possibility to provide for laps on purpose in the area of the great transitions when the two tubes located in their mold parts are pushed together so far as to bring on such laps. This is however only possible when the flowability of the material in itself is increased in the area of these great transitions, this flowability being achieved by heating the workpiece and/or the mold more in this area than in the others.

Another object of the invention is a tool for producing a hollow body made of metal with at least one area of great deformation provided with a steep transition. According to the invention, such a mold is characterized by mold parts that are arranged on a common central axis and that are advantageously identical and mirror-inverted. The mold parts are hereby joined together in longitudinal direction of the mold in the center thereof, the at least one steep, protruding transition, that is the area of the great deformation, being respectively arranged in the mold part in the vicinity of the two mold parts.

DESCRIPTION OF THE PREFERRED EMBODIMENT(S)

Figure 1:
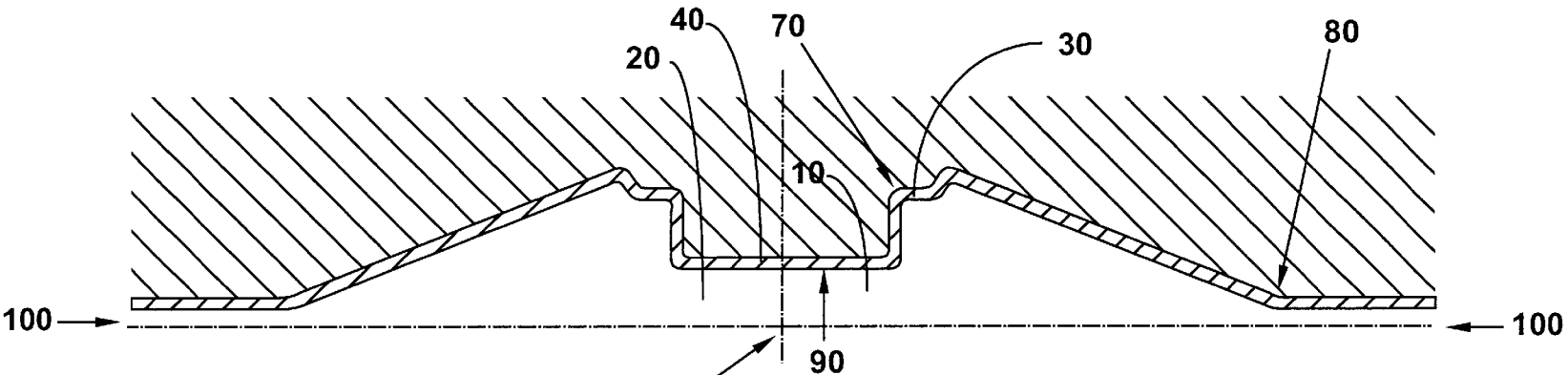
FIG. 1 is a schematic sectional view of the double mold containing a deformed hollow body.
Figure 2:
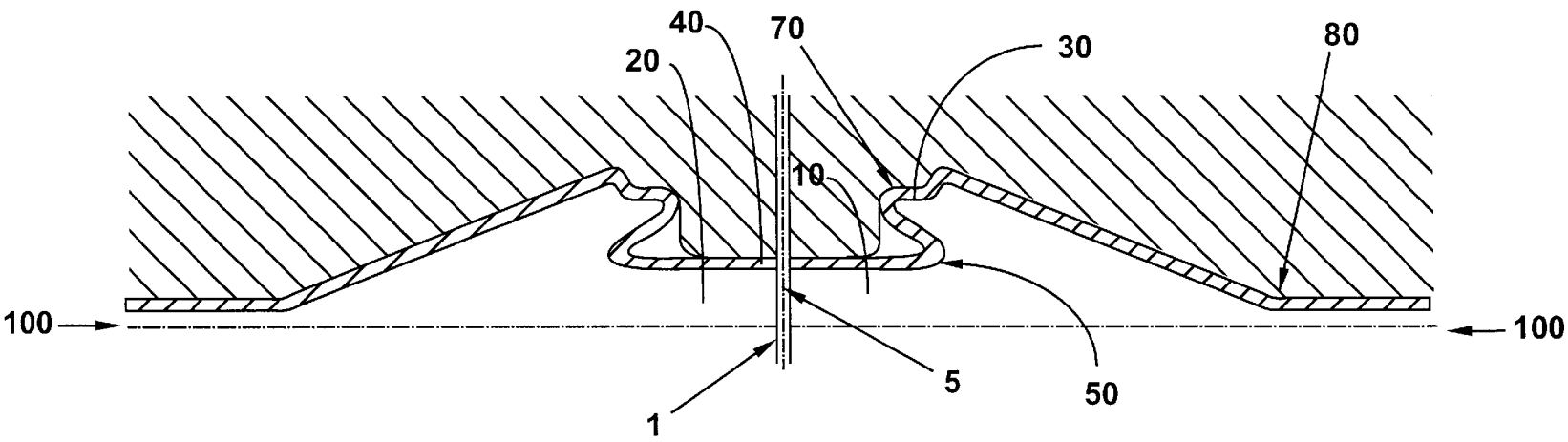
FIG. 2 is a schematic sectional view of the double mold with a lap.

The invention will be explained more explicitly in the following by way of example with the help of the drawings. FIG. 1 shows a mold 1 with two mold halves 10 and 20, both containing a shaped metallic hollow body 30, 40. In the embodiment illustrated in FIG. 1, the hollow body has no lap, whereas such a lap 50 may be seen in FIG. 2. The essential point is that the slug or the mold 1 is much more heated in the area of the steep, widely protruding transitions, said area being indicated by the arrow 70 in FIGS. 1 and 2, than in the area indicated by the arrow 80. As a result, the material of the metallic hollow body is much more flowable in the area of the arrow 70 than in the area of the arrow 80.

As a result and thanks to the greater rigidity of the material in the area of the arrow 80, the axial force exerted in direction of the arrow 100 can be carried on through the material until it reaches the area of the steep transitions 70. This means that the shaping of the tubular body is ensured in any case in the area of the arrow 70. This is still aided by the fact that the two slugs are pushed against each other during deformation by internal pressure, the small distance between the two parts with great deformation in the two mold parts ensuring that the material actually flows into the area indicated by the arrow 70, so that it is made certain that after deformation the thickness of the material is essentially the same on the whole surface of the body.

This may be explained as follows: when pushing the material in direction of the arrow 100, the steep transition (arrow 70) acts as a natural barrier that first prevents further material from flowing from the direction of arrow 100 to the area of arrow 90 since the resistance encountered at the steep transition is too high. But as material actually must flow from the area designated by arrow 90 to the area of the arrow 70, tensile stress builds up in the area of the arrow 90. This stress ensures that no laps occur under normal circumstances. Only when material continues to be pushed from the direction of the arrows, laps form according to FIG. 2. Therefore however, it is necessary that the form be divided in its center by the formation of a gap (arrow 5), so that each slug may be upset individually.

I claim:

1. A method for producing a hollow body made of metal whose cross section changes in longitudinal direction, comprising the steps of sealing a tubular slug at a first end and a second end of said slug and placing said slug into a mold that corresponds to a desired shape of said hollow body, putting said slug under high pressure by means of a pressure means, and deforming said slug over an area having greater and smaller deformations by pressing said first end and said second end of said slug against each other in axial direction, said slug being heated over said area to be deformed with such heating being not uniform and at a higher temperature in the area of greater deformations than in the area of smaller deformations.

2. The method according to claim 1, wherein said mold (1) has, in axial direction, two mold halves (10, 20).

3. The method according to claim 2, wherein said mold halves are mirror-inverted.

4. The method according to claim 1, wherein an area of greater deformation has a transition (70) with an angle of more than 45° but of less than 90°.

* * * * *